US006959233B2

(12) United States Patent
Hungate et al.

(10) Patent No.: US 6,959,233 B2
(45) Date of Patent: Oct. 25, 2005

(54) AUTOMATED VOICE TRANSMISSION OF MOVEMENT AUTHORITIES IN RAILROAD NON-SIGNALED TERRITORY

(75) Inventors: Joseph Hungate, Marion, IA (US); Robert Haag, Frederick, MD (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/678,377

(22) Filed: Sep. 30, 2003

(65) Prior Publication Data

US 2004/0176884 A1 Sep. 9, 2004

Related U.S. Application Data

(60) Provisional application No. 60/417,433, filed on Oct. 10, 2002.

(51) Int. Cl.[7] ..... B61L 3/00; B61L 25/02
(52) U.S. Cl. ..... 701/19; 701/23; 370/313
(58) Field of Search ..... 701/19, 23, 70, 701/50, 117; 370/313, 350; 340/7.21, 7.31; 455/517, 521; 246/2 R

(56) References Cited

U.S. PATENT DOCUMENTS

| | | | | |
|---|---|---|---|---|
| 3,678,391 | A * | 7/1972 | Gough | 370/313 |
| 4,307,859 | A * | 12/1981 | Hayashi et al. | 246/124 |
| 4,711,418 | A * | 12/1987 | Aver et al. | 246/5 |
| 5,452,870 | A | 9/1995 | Heggestad | |
| 5,533,695 | A * | 7/1996 | Heggestad et al. | 246/62 |
| 5,828,979 | A * | 10/1998 | Polivka et al. | 701/117 |
| 5,950,966 | A | 9/1999 | Hungate et al. | |
| 6,295,449 | B1 * | 9/2001 | Westerlage et al. | 455/422.1 |
| 6,366,782 | B1 * | 4/2002 | Fumarolo et al. | 455/457 |
| 6,466,847 | B1 * | 10/2002 | Horst | 701/29 |
| 6,823,242 | B1 * | 11/2004 | Ralph | 701/19 |

* cited by examiner

*Primary Examiner*—Thomas G. Black
*Assistant Examiner*—Dalena Tran
(74) *Attorney, Agent, or Firm*—Buchanan Ingersoll PC

(57) ABSTRACT

A method and system to authorize a locomotive engineer to move a train along the track in a non-signaled territory wherein a non-verbal movement authority is generated, converted to verbal form via voice synthesis, communicating to the designated train, and accepted or rejected by a locomotive engineer on such train. Secure codes can be utilized to regulate reception of, and/or acceptance or rejection of, the movement authority.

22 Claims, 2 Drawing Sheets

AUTOMATED VOICE TRANSMISSION OF MOVEMENT AUTHORITIES IN RAILROAD NON-SIGNALED TERRITORY

RELATED APPLICATIONS

This application claims priority from U.S. Provisional Patent Application Ser. No. 60/417,433, filed Oct. 10, 2002.

BACKGROUND

The present invention relates generally to verbal communication based train management systems for "non-signaled" territories, and more particularly to an automated voice transmission method and system for authorizing the movement of trains in such non-signaled territories.

North American railroads currently operate trains in what is commonly called "signaled" and "non-signaled" territories. In signaled territories, the authorization for the locomotive engineer (locomotive driver) to move the train along the track is via wayside signals. These signals are analogous to traffic lights for private motor vehicles operating on highways. Signaled territory will support a greater number of trains per hour than non-signaled territory, but also requires an expensive infrastructure.

In non-signaled territory, the authorization for the locomotive engineer to move the train along the track is via a verbal movement authority. The non-signaled territory movement authority is generated by a train dispatcher located at a central train dispatching office. The dispatcher is typically aided in the generation of the movement authority by a conventional computer aided movement authority computer which is programmed to help assure that only non-conflicting authorities are generated. The movement authority is then read to the locomotive engineer via a voice radio communications system. The locomotive engineer writes the movement authority on a prescribed form and then reads it back to the dispatcher for confirmation. The dispatcher confirms that the locomotive engineer has read it correctly and the movement authority is then considered "in effect." This method of movement authority granting is time consuming and prone to human error. The read/read-back method does little for enhancing the safety of the operations.

Consequently, there is a need for a system and method for granting movement authority in non-signaled territories which is both more efficient and less prone to human error than the present verbal movement authority procedure described above.

SUMMARY

The invention provides an automated voice transmission method and system for authorizing the movement of trains in non-signaled territories. According to the invention, a dispatcher can generate a non-verbal movement authority for a designated train in non-signaled territory. The non-verbal movement authority can then be converted to verbal form, such as by using voice synthesis, and then transmitted to the designated train. The verbal movement authority can be received and listened to by a locomotive engineer on the designated train, after which the engineer will transmit either acceptance or rejection of the movement authority back to the dispatcher. The dispatcher may then transmit to the engineer on the designated locomotive a confirmation that the acceptance or rejection was received.

Preferably, security provisions can also be provided, such as, for example, requiring the locomotive engineer to use a secure code to receive the movement authority and/or when transmitting the acceptance or rejection message back to the dispatcher. As an added safety measure, the initial non-verbal movement authority can also be transmitted to the designated train as a text message displayed on a screen on-board the locomotive. The locomotive engineer can use the text message to confirm that the verbal message was heard correctly.

The dispatcher can be aided in the generation of an initial digital non-verbal movement authority by conventional computer aided movement authority computers which are programmed to help assure that only non-conflicting authorities are generated. A movement authority transmission voice synthesizer then converts the digitized authority into spoken words that adhere to current railroad operating rules pertaining to the spelling out of location names and mile post numbers.

Train position coordinates can be correlated with the movement authority to be issued, in order to instruct conventional railroad voice radio communications dispatch office equipment to automatically select the appropriate voice radio base station, i.e., the base station closest to the designated train, via which the movement authority will be communicated. The voice synthesized movement authority will then be transmitted to the locomotive engineer on the designated train. The train location coordinates can be derived from GPS position reports and/or locomotive identification reports. The train position information can be transmitted from the locomotive on the designated train via, for example, a conventional voice radio transceiver, and can be received by, for example, a conventional railroad voice radio communications system. On board the locomotive, GPS position reports can be derived from a commercially available GPS receiver, converted into very short data messages, and then transmitted periodically via sub-audible techniques that are currently utilized in conventional voice radio communication networks.

Other details, objects, and advantages of the invention will become apparent from the following detailed description and the accompanying drawings figures of certain embodiments thereof.

BRIEF DESCRIPTION OF THE DRAWINGS

A more complete understanding of the invention can be obtained by considering the following detailed description in conjunction with the accompanying drawing figures, in which.

DETAILED DESCRIPTION

Figure 1:
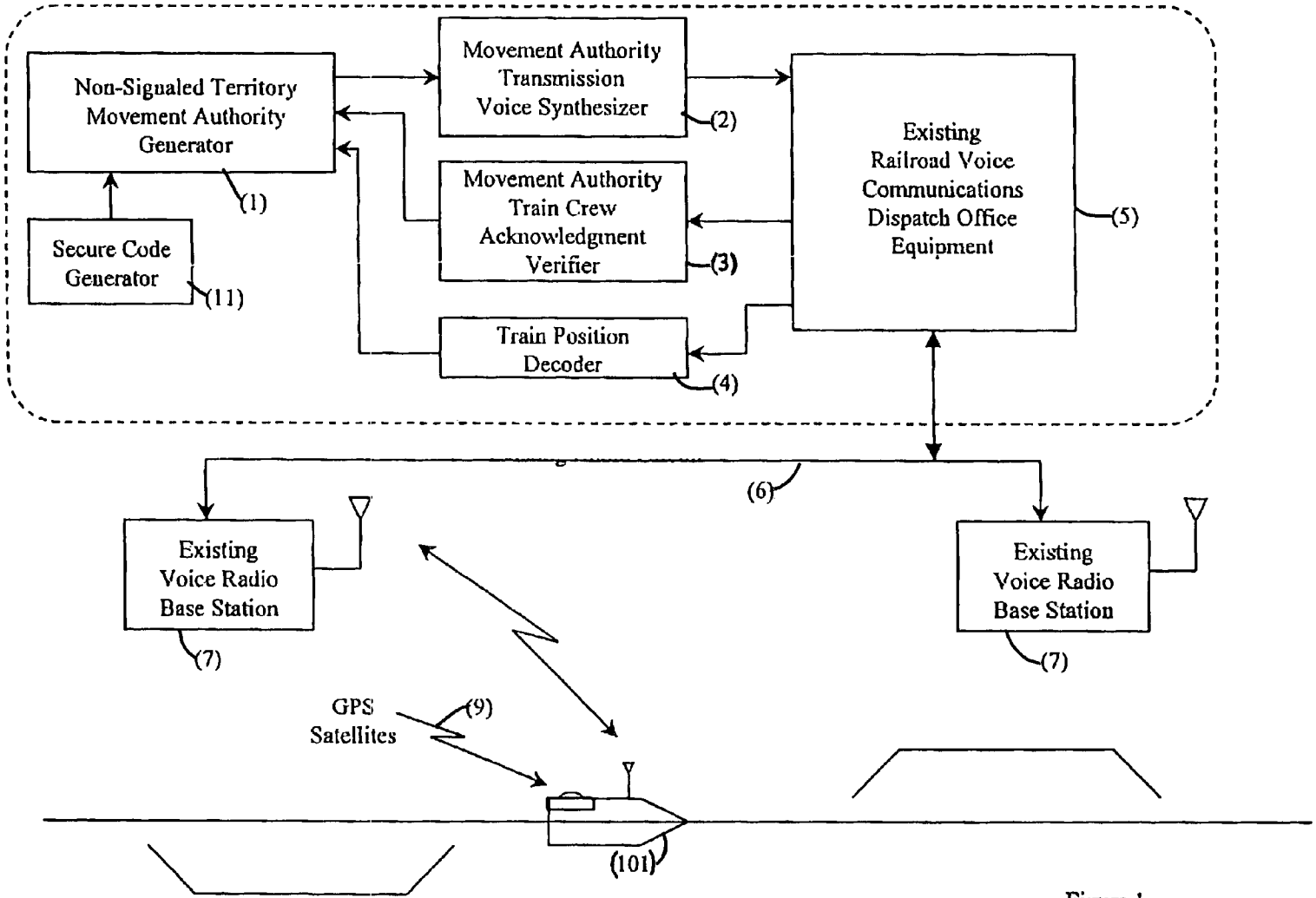
FIG. 1 is a block diagram of an embodiment of system for the automated voice transmission of movement authorities in a railroad non-signaled territory.

Referring now to the drawing figures, a block diagram of an embodiment of system for the automated voice transmission of movement authorities in a railroad non-signaled territory is depicted in FIG. 1, wherein the system contemplates the interaction of subsystems at, for example, a train dispatch office, on-board trains moving in non-signaled territory, and remote communication devices, for example, radio base stations located generally intermediate the dispatch offices and the trains. In general, a non-verbal movement authority for a designated train traveling in a non-signaled territory is generated at a central operations facility, for example, a train dispatch office, is then converted into a verbal form and transmitted via an appropriate base station to the designated train. More particular aspects of the invention are described in detail hereinafter.

Generation of Non-Signaled Territory Movement Authority

At the desired time, a train dispatcher can generate a non-verbal, non-signaled movement authority using, for example, a conventional computer aided movement authority generator 1. Computer aided movement authority generation computers and their operation are well known. These computers have software which assists the dispatcher in generating the movement authority and assures that only non-conflicting authorities are generated. Non-conflicting movement authorities are those which permit only a single train to occupy a specific section of track at any given time, thus preventing train collisions. Conventional operation still requires the read and read-back scenario as described previously.

Voice Synthesis of Digitized Movement Authority

The non-verbal movement authority generated by the movement authority generator 1 is delivered, for example in a digitized format, to a device which converts the non-verbal movement authority into verbal form. This device can be, for example, a movement authority transmission voice synthesizer 2. The movement authority transmission voice synthesizer 2 converts the digitized non-verbal authority into spoken words, in a format which adheres to current railroad operating rules pertaining to location names and mile post numbers.

Movement Authority and Train Location Correlation

Generally, the verbal movement authority is then transmitted by a first voice communications device, for example by conventional, existing railroad voice communications dispatch office equipment 5, to the designated train 101 where it is received by a second voice communications device, for example a conventional on-board locomotive voice radio transceiver 10*b*. More particularly, according to one presently preferred embodiment of the invention, the system includes a train position decoder 4 which correlates the position coordinates of the designated train 101 with the particular movement authority to be issued. The train position decoder 4 selects, via the existing railroad voice radio communications dispatch office equipment 5, an appropriate third voice communications device, for example a voice radio base station 7. Specifically, the voice radio base station 7 closest to the designated train 101 will be selected by the train position decoder 4 to transmit the verbal movement authority to the designated train 101. The voice synthesized movement authority is thus communicated from the dispatch office to the nearest base station 7 via an existing audio circuit 6 and thence to the designated train 101.

Figure 2:
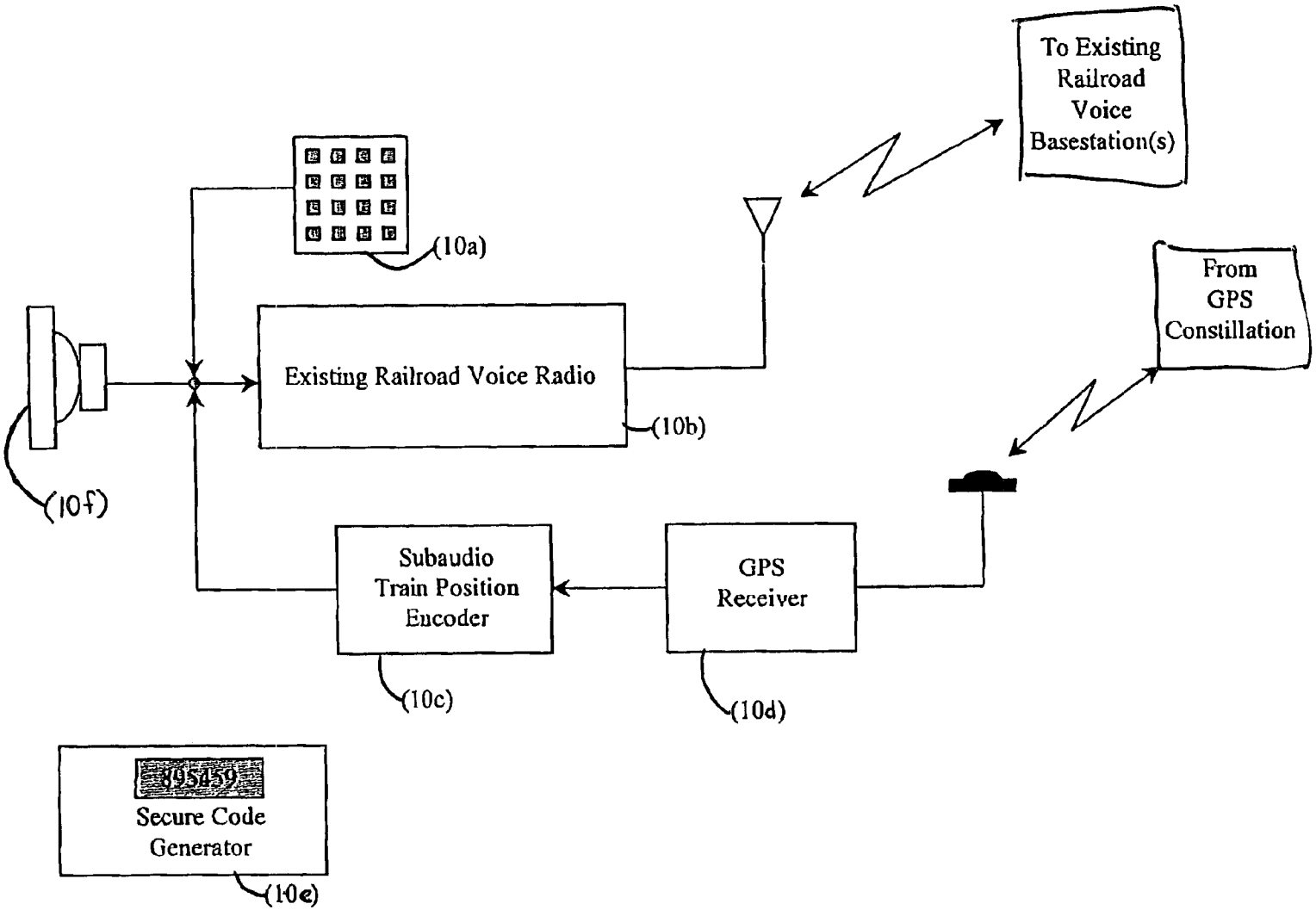
FIG. 2 is a block diagram of an embodiment of an on-board locomotive portion of a system such as depicted in FIG. 1.

The position coordinates for the designated train 101 can be derived from GPS position reports 9, for example via a conventional GPS receiver 10*d* and sub-audio train position encoder 10*c*, shown in FIG. 2. Locomotive identification information can also be used to devise the position coordinates. The train 101 location information can be transmitted off-board the locomotive of the designated train 101 by the conventional on-board locomotive voice radio transceiver 10*b*. The transmission from the locomotive voice radio transceiver 10*b* can be communicated to the existing railroad voice communications dispatch office equipment 5 via the aforementioned voice radio base stations 7 and existing audio circuit 7, depicted in FIG. 1. On board the locomotive, the GPS position reports can be derived from the GPS receiver 10*d* and converted by the sub-audio train position encoder 10*c* into very short data messages and transmitted periodically via sub-audible techniques that are currently deployed in conventional voice radio communication networks.

Confirming Train Crew is Ready to Receive Movement Authority

Prior to transmitting the voice synthesized, verbal movement authority to the locomotive engineer, or other train crew member, on the designated train 101, the system determines whether the train crew member is ready to receive the verbal authority. According to the invention, the system, i.e., the train dispatch office, can announce over the appropriate voice radio base station 7, selected as described above, that it has a message for the designated train 101. The engineer on the designated train 101 then notifies, such as via the same voice radio base station, the dispatch office that it may transmit the movement authority. A secure code may be employed, which can be generated by a secure code generator 10*e* and transmitted from the designated train 101 to the dispatch office, for example, via a Dual Tone Multiple Frequency (DTMF) key pad 10*a*, which is incorporated in most modern day train communication systems.

The secure code transmitted from the designated train 101 must match the secure code that is expected by the dispatch office voice communications equipment 5, and in particular the movement authority train crew acknowledgement verifier 3, before the movement authority can be transmitted. A secure code generator 11 at the dispatch office generates the secure code which must be matched by the secure code transmitted from the designated train 101.

According to the invention, there can be a secure code generator 10*e* located on-board a locomotive of each train, of which train 101 is an example, and a non-signaled territory movement authority secure code generator 11 resident at the train dispatch office. The secure code generators can employ, for example, a very precise internal clock and a multiple digit number generation algorithm. This provides a means for identical numbers to be generated at both the dispatch office and on-board each train 101. The secure code generator 10*e* on-board the train 101 can utilize conventional technology.

The non-signaled territory movement authority generation secure code generator logic can use the same secure code generation algorithms as on-board each train 101 to assure that there is a unique code for each train 101 and each movement authority. Also, to help assure uniqueness among codes, the lead locomotive identification on the designated train 101 can be used as part of the acknowledgement message transmitted off board the train 101.

After the crew on the designated train 101 enters a valid secure code via the DTMF pad 10*a*, and the code and locomotive identification are confirmed by the movement authority train crew acknowledgement verifier 3, the synthesized voice movement authority will be transmitted to the designated train 101.

Acknowledgement of Received Movement Authority

According to the invention, the engineer, or crew member, on-board the designated train 101 can write the received verbal movement authority onto a prescribed form, just as it is conventionally done in non-signaled territory operations. If desired by the railroad, both the locomotive engineer and the conductor on the designated train 101 can be required to independently acknowledge the movement authority via separate DTMF microphones. It should be noted that most locomotives today are equipped with separate microphones for the conductor and engineer.

If the train crew has copied the movement authority, understands it, and is ready to operate the train in adherence to the movement authority, the next step is to acknowledge the receipt of the movement authority. The acknowledgment process can also rely upon the use of the secure code procedure described above. If the train crew accepts the movement authority the secure code numbers followed by the letter "A" (for accept) are entered via the DTMF pad 10*a*. If the movement authority is rejected, the secure code numbers are entered followed by the letter "R" (for reject). If the movement authority is rejected, the movement authority train crew acknowledgement verifier 3 can automatically notify the train dispatch office.

Other Possible Safety Enhancements

As an added safety measure, the initial generated non-verbal movement authority can also be transmitted to the designated train as a text message, and displayed on a screen on-board the designated train 101. An existing display screen on-board the locomotive of the designated train 101 can be used if available, otherwise a simple display device can be provided. The text message can be used as a back-up to the verbal movement authority. The locomotive engineer can use the text message to confirm that the verbal message was heard, and written down, correctly.

The use of the secure code technique can prevent the false acknowledgment of a movement authority by unauthorized personnel or by crew members on a train other than the designated train 101. Another means for securing safety of operations can be to employ conventional, currently available voice encrypting techniques. The movement authority transmission voice synthesizer 2 could transmit an encryption access code to the designated train 101. The voice communications radio 10*b* on-board the train 101 would then switch to a mode wherein that radio 10*b*, and only that radio, would be capable of decrypting the voice message. The acknowledgement process would adhere to the technique described above and would also be encrypted.

Although certain embodiments of the invention have been described in detail hereinabove, it will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. An automated voice transmission method to authorize the movement of trains in non-signaled territory, said automated voice transmission method comprising:

a. generating a non-verbal movement authority for a designated train in said non-signaled territory;

b. converting said non-verbal movement authority to a verbal movement authority;

c. communicating said verbal movement authority to said designated train;

d. receiving said verbal movement authority on-board said designated train; and e. communicating acceptance or rejection of said verbal movement authority from on-board said designated train.

2. The automated voice transmission method of claim 1 further comprising communicating to said designated train confirmation of said acceptance or rejection.

3. The automated voice transmission method of claim 1 further comprising requiring a secure code to authorize receiving said verbal movement authority.

4. The automated voice transmission method of claim 1 further comprising requiring a secure code to authorize acceptance or rejection of said verbal movement authority.

5. The automated voice transmission method of claim 1 further comprising:

a. requiring a first secure code to authorize receiving said verbal movement authority; and b. requiring a second secure code to authorize acceptance or rejection of said verbal movement authority.

6. The automated voice transmission method of claim 1 further comprising:

a. identifying a location of said designated train;

b. selecting a communication device nearest said location of said designated train; and c. communicating said verbal movement authority to said designated train via said communication device.

7. The automated voice transmission method of claim 6 wherein said identifying further comprises communicating position information from said designated train to a dispatch office at which said movement authority is generated.

8. The automated voice transmission method of claim 7 further comprising:

a. receiving GPS position information on-board said designated train; and b. communicating said GPS position information from said designated train to said dispatch office.

9. The automated voice transmission method of claim 8 further comprising communicating locomotive identification information from said designated train to said dispatch office.

10. The automated voice transmission method of claim 1 further comprising communicating said non-verbal movement authority to said designated train in text format for comparison with said verbal movement authority.

11. The automated voice transmission method of claim 10 further comprising generating said non-verbal movement authority using a computer aided system that assures only non-conflicting movement authorities are generated.

12. An automated voice transmission system to authorize the movement of trains in non-signaled territory, said automated voice transmission system comprising:

a. a movement authority generator which generates a non-verbal movement authority for a designated train in said non-signaled territory;

b. a movement authority voice-synthesizer which converts said non-verbal movement authority to a verbal movement authority;

c. a first voice communications device which communicates said verbal movement authority to said designated train; and d. a second voice communications device on-board said designated train which receives said verbal movement authority and communicates acceptance or rejection thereof to said first voice communication device.

13. The automated voice transmission system of claim 12 further comprising said first communication device communicating confirmation of said acceptance or rejection to said second communication device.

14. The automated voice transmission system of claim 12 further comprising a first secure code generator generating a first secure code associated with said verbal movement authority wherein said designated train must communicate a second secure code corresponding to said first secure code in order to authorize the communication of said verbal movement authority to said designated train.

15. The automated voice transmission system of claim 14 further comprising a movement authority train crew acknowledgment verifier which compares said first secure code to said second secure code and authorizes communication of said verbal movement authority to said designated train if said first and second secure codes correspond.

16. The automated voice transmission system of claim 15 further comprising said movement authority train crew acknowledgment verifier comparing said first secure code to said second secure code to verify acceptance or rejection of said verbal movement authority communicated from said designated train in response to reception of said verbal movement authority.

17. The automated voice transmission system of claim 14 further comprising a second secure code generator on-board said designated train, said second secure code generator generating said second secure code corresponding to said first secure code in order to authorize communication of said verbal movement authority.

18. The automated voice transmission system of claim 12 further comprising:

a. a plurality of third voice communication devices selectively communicable between said first and second voice communication devices; and b. a train position decoder which selects one of said plurality of third communication devices nearest said designated train to communicate said verbal movement authority from said first communications device to said second communications device.

19. The automated voice transmission system of claim 12 further comprising said second communication device communicating at least one of GPS position information and train identification information to said first communication device, said first communication device communicating said at least one of GPS position information and train identification information to said train position decoder for determine said one of said plurality of third communication devices nearest said designated train.

20. The automated voice transmission system of claim 19 further comprising:

a. a train position encoder on-board said designated train;

b. a GPS receiver on-board said designated train receiving GPS position information and communicating said GPS position information to said train position encoder; and c. said train position encoder communicating said GPS position information to said second voice communications device for communication thereby to said train position decoder via said first voice communications device.

21. The automated voice transmission system of claim 12 further comprising:

a. said non-verbal movement authority generated by said movement authority generator communicated to said designated train in a text format; and b. a display screen on-board said designated train which displays said non-verbal movement authority in said text format to enable verification of said verbal movement authority.

22. The automated voice transmission system of claim 12 wherein said movement authority generator further comprises a computer aided system that assures only non-conflicting movement authorities are generated.

* * * * *